United States Patent [19]

Walter et al.

[11] 4,417,552

[45] Nov. 29, 1983

[54] SOUND-INSULATED INTERNAL-COMBUSTION ENGINE

[75] Inventors: Horst Walter, Gross-Denkte; Werner Ebbinghaus; Hermann Danckert, both of Wolfsburg, all of Fed. Rep. of Germany

[73] Assignee: Volkswagenwerk A.G., Wolfsburg, Fed. Rep. of Germany

[21] Appl. No.: 327,505

[22] Filed: Dec. 4, 1981

[30] Foreign Application Priority Data

Dec. 11, 1980 [DE] Fed. Rep. of Germany ..... 3046602

[51] Int. Cl.[3] ..... F02F 7/00

[52] U.S. Cl. ..... 123/198 E; 123/195 C; 181/204

[58] Field of Search ..... 123/198 E, 195 C, 195 S; 181/204

[56] References Cited

U.S. PATENT DOCUMENTS

| | | | |
|---|---|---|---|
| 3,464,398 | 9/1969 | Scheiterlein et al. | 123/198 E |
| 3,810,526 | 5/1974 | Kawasaki | 123/198 E |
| 4,071,008 | 1/1978 | Skatsche | 123/195 S |
| 4,077,383 | 3/1978 | Hatz | 123/198 E |
| 4,186,714 | 2/1980 | Danckert et al. | 123/195 S |
| 4,202,311 | 5/1980 | Moriyoshi | 123/198 E |
| 4,215,664 | 8/1980 | Hatz | 123/198 E |
| 4,219,002 | 8/1980 | Danckert et al. | 123/195 C |
| 4,224,919 | 9/1980 | Appelbaum | 123/198 E |
| 4,378,763 | 4/1983 | Tshihama | 123/198 E |

FOREIGN PATENT DOCUMENTS

| | | | |
|---|---|---|---|
| 2723397 | 1/1978 | Fed. Rep. of Germany | 123/198 E |

*Primary Examiner*—Ira S. Lazarus

*Attorney, Agent, or Firm*—Spencer & Frank

[57] ABSTRACT

An internal combustion engine includes an engine block, an oil pan, a sound insulating capsule and a sealing gasket connecting the oil pan to an underside of the engine block. The sealing gasket has folds for permitting a relative displacement between the engine block and the oil pan during operation of the engine. The sealing gasket is supported on a lower portion of the capsule as a component thereof, while the capsule is supported externally of the engine. A closure plate is sealingly secured to the engine block for covering an underside of the engine block. The plate has an oil return opening whose dimensions are small relative to length and width dimensions of the closure plate and the oil pan. The closure plate and the oil pan carry nipples which are in alignment with one another and to which the sealing gasket is secured.

4 Claims, 3 Drawing Figures

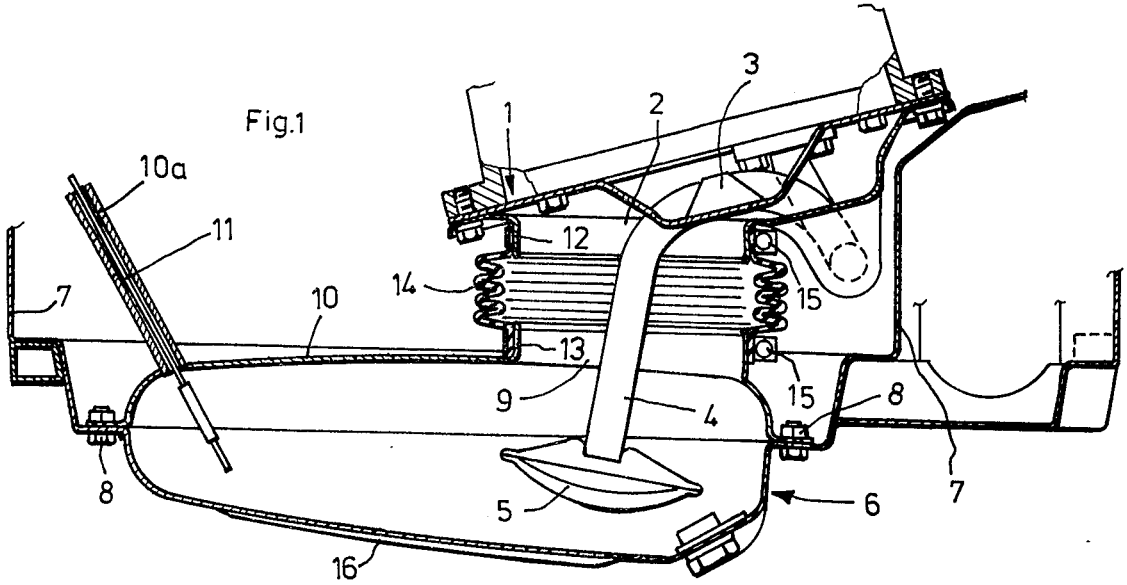
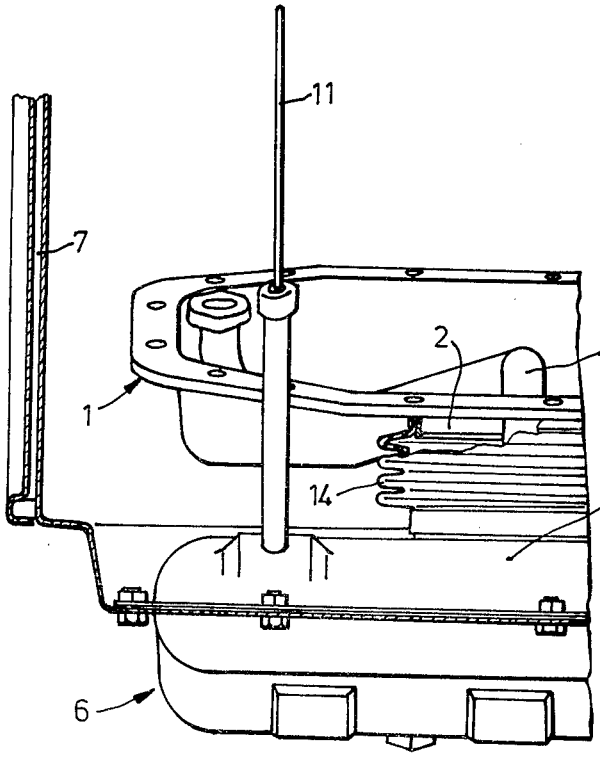
Fig.2

SOUND-INSULATED INTERNAL-COMBUSTION ENGINE

BACKGROUND OF THE INVENTION

This invention relates to an internal-combustion engine which is encapsulated in a sound-insulating manner and which has an oil pan which is attached to the engine block by means of a sealing gasket. The gasket has folds which permit relative displacements between the engine block and the oil pan during operation of the engine. The gasket is held at a lower zone of the capsule as a component thereof, while the capsule itself is affixed externally of the engine, for example, to a vehicle chassis or body.

An internal-combustion engine of the above-outlined type, disclosed, for example, in U.S. Pat. No. 4,186,714 issued Feb. 5, 1980, provides that neither the oil pan, nor the sound insulating capsule need be rigidly affixed to the internal-combustion engine, even when the engine, during operation, executes displacements relative to its environment (such as a chassis in case the engine is installed in an automative vehicle). According to the embodiments described in the above-noted patent, the oil pan forms an upwardly open shell (that is, a shell open towards the engine) and the sealing gasket has to be of such a dimension that it extends over the entire length and width of the oil pan. This requires that the sealing gasket be affixed by a large number of uniformly distributed bolts to the flange of the oil pan for achieving the required sealing effect at all locations.

SUMMARY OF THE INVENTION

It is an object of the invention to provide an improved encapsulated soundproof internal-combustion engine wherein a simplified structure and mounting of a sealed connection, permitting relative motions between the engine block (or, as the case may be, cylinder block) and the oil pan are ensured without sacrificing the advantageous structural principle of a dry, soundproof capsule and the suspension of the oil pan on the capsule as disclosed in the above-noted U.S. Pat. No. 4,186,714.

This object and others to become apparent as the specification progresses, are acomplished by the invention, according to which, briefly stated, the engine block is sealingly covered at the bottom by means of a closure plate which has a circular or oval oil return opening that is relatively small as compared to the longitudinal and width dimensions of the closure plate and the oil pan and further, the oil pan and the closure plate have substantially aligned nipples to which the ends of the sealing gasket are affixed.

It is an advantage of the invention that, by virtue of the small dimensions of the oil return opening relative to the engine block and the oil pan, the oil dipstick may be supported without difficulty externally of the internal-combustion engine proper.

It is noted that a reinforcing closure plate for internal-combustion engines is disclosed, for example, in U.S. Pat. No. 3,464,398, issued Sept. 2, 1969. The capsule described therein is formed by an oil pan, more particularly, by oil pan walls that reach to the height of the cylinders and are connected there to the engine block in a soundproof manner. The oil reservoir proper is attached to the bottom of the walls. The side walls extend inwardly through the engine so that they form there—although only in that direction—an oil return opening which is of reduced size as compared to the dimensions of the engine block and the oil reservoir. In contradistinction to the "dry" capsule with which the invention is concerned, in the arrangement disclosed in U.S. Pat. No. 3,464,398, the engine capsule is a "wet capsule" which is affixed directly to the internal-combustion engine rather than externally thereto (for example, to the chassis of a vehicle). Consequently, in the prior art arrangement the problem of an oil-tight connection between the engine block and the oil pan for providing a "dry capsule" is not encountered.

While in principle it is feasible to arrange the oil suction conduit externally of the sealing gasket, according to a further feature of the invention, the oil suction conduit extends internally of the sealing gasket.

BRIEF DESCRIPTION OF THE DRAWING

FIG. 1 is a sectional side elevational view of a preferred embodiment of the invention, with the engine block only indicated.

FIG. 2 is a front elevational view of the same embodiment, with the engine block removed.

DESCRIPTION OF THE PREFERRED EMBODIMENT

Figure 3:
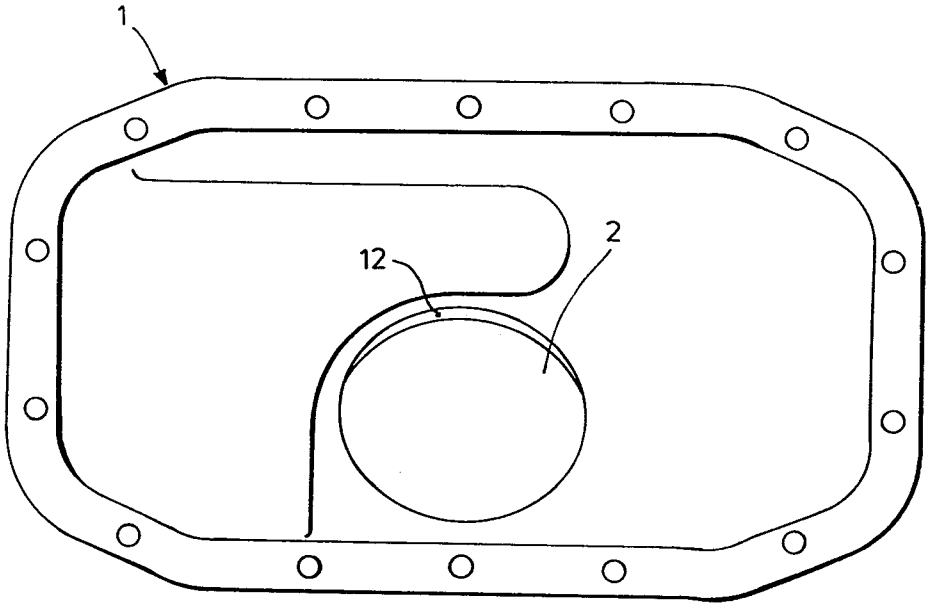
FIG. 3 is a top plan view of the closure plate only showing in detail the oil return opening.

Turning now to the Figures, the engine block (only symbolically shown) is at its bottom tightly closed by means of a closure plate 1 which may be of sheet metal or may be a cast component and which is provided with an oil return opening 2. In the embodiment illustrated, the closure plate 1 is a sheet metal member which is so shaped that it forms a support 3 for an oil suction conduit 4 whose lower end, conventionally provided with an oil filter 5, extends into an oil pan (sump) 6. The oil pan 6 is a component of a dry capsule 7 which is supported on a vehicle body or the like in a known manner. The oil pan 6 is secured to the capsule 7 by means of bolts 8. Since the capsule is a "dry" capsule, the connection by means of the bolts 8 need not necessarily be oil-tight.

The oil return opening 2 and an opening 9 which is in registry therewith and which is provided in the oil sump 6 are of significantly smaller size than the corresponding dimensions of the closure plate 1 and the oil pan 6. Consequently, the oil sump 6 does not have the shape of an upwardly open pan but it also has a top wall 10 which extends externally of the outline of the engine block and which thus may be equipped itself with a support tube **10*a* for holding an oil dipstick 11 which passes through the capsule 7**.

For providing, between the engine block and the oil pan 6, an oil-tight connection which permits relative motion between the engine block and the oil pan, the closure plate 1 and the upper wall 10 of the oil sump 6 have preferably annular nipples 12 and 13 which are oriented towards one another and to the end of which a bellows-like sealing gasket 14 is affixed, for example, by means of clamping straps 15.

The oil sump 6 is, in a known manner, provided with longitudinally extending embossed ribs 16 for reinforcement and for increasing the cooling effect.

By virtue of the simple, oil-tight connection between the engine block and the oil sump 6, the construction according to the invention is well adapted even for a subsequent incorporation in, for example, internal-combustion engines for automative vehicles. The closure plate 1, with the intentionally small oil return oil opening 2 does not transmit downwardly the vibrations caused by the reciprocation of the engine pistons and in addition, the oil pan, together with the oil quantities accommodated therein, has a sound dampening effect.

Though the dimensions of oil pan 6, closure plate 1 and oil return opening 2 will depend highly on the individual circumstances, suitable length dimensions as seen in FIG. 1 are about 280 mm for oilpan 6 and 200 mm for closure plate 1, respectively, oil return opening 2 having a diameter of about 100 mm. The dimensions of oil pan 6 and closure plate 1 in the plane of FIG. 2 may be about 320 mm.

It will be understood that the above description of the present invention is susceptible to various modifications, changes and adaptations and the same are intended to be comprehended within the meaning and scope of equivalents of the appended claims.

What is claimed is:

1. In an internal combustion engine including an engine block, an oil pan, a sound insulating capsule and a sealing gasket connecting said oil pan to an underside of said engine block; said sealing gasket having folds for permitting a relative displacement between said engine block and said oil pan during operation of said engine; said sealing gasket being supported on a lower portion of said capsule as a component thereof; said capsule being supported externally of said engine; the improvement comprising (a) a closure plate sealingly secured to said engine block for covering said underside of the engine block;

(b) means defining an oil return opening in said closure plate; the dimensions of said opening being small relative to length and width dimensions of said closure plate and said oil pan; and (c) a first nipple mounted on said closure plate and a second nipple mounted on said oil pan; said nipples being in alignment with one another; said sealing gasket having end portions sealingly secured to said nipples.

2. An internal combustion engine as defined in claim 1, further comprising an oil suction conduit extending from said engine block into said oil pan through said sealing gasket.

3. An internal combustion engine as defined in claim 1, wherein said oil return opening is circular.

4. An internal combustion engine as defined in claim 1, wherein said oil return opening is oval.

* * * * *